US005878621A

United States Patent [19]

Vadin-Michaud

[11] Patent Number: 5,878,621

[45] Date of Patent: Mar. 9, 1999

[54] VEHICLE ENGINE STARTER HAVING IMPROVED MEANS FOR ATTACHING THE DRAW MEMBER OF THE CONTRACTOR TO THE CONTROL FORK FOR THE STARTER HEAD

[75] Inventor: Gilles Vadin-Michaud, Villeurbanne, France

[73] Assignee: Valeo Equipements Electriques Moteur, Creteil, France

[21] Appl. No.: 889,283

[22] Filed: Jul. 8, 1997

[30] Foreign Application Priority Data

Jul. 10, 1996 [FR] France ..... 96 08718

[51] Int. Cl.[6] ..... F02N 15/06

[52] U.S. Cl. ..... 74/7 A; 335/131; 403/353

[58] Field of Search ..... 74/7 A; 335/131; 403/353

[56] References Cited

U.S. PATENT DOCUMENTS 3,750,066 7/1973 Lazenby ..... 335/274
4,346,615 8/1982 Yoneda et al. ..... 74/7 A
4,958,097 9/1990 Woodward et al. ..... 74/7 A X
5,469,753 11/1995 Vadin-Michaud et al. ..... 74/7 A

FOREIGN PATENT DOCUMENTS 2117937 7/1972 France .
2349227 11/1977 France .

OTHER PUBLICATIONS

French Search Report dated 27 Mar. 1997.

*Primary Examiner*—Allan D. Herrmann
*Attorney, Agent, or Firm*—Morgan & Finnegan, L.L.P.

[57] ABSTRACT

In a motor vehicle starter, a pivoted control lever acts on a starter head, the free upper end of the control lever being attached to the free rear end of a draw bar for actuating the lever. The draw bar is part of the starter contractor. The front end of the draw bar has a thrust head engaged with a compression spring mounted in a movable core of the contractor. The attachment means coupling the draw bar to the control lever include a hook portion at the rear end of the draw bar, this hook portion being received in a complementary recess formed, in facing relationship with it, in the upper end of the control lever. The draw bar is generally in the form of a plate lying in a plane containing the direction in which the draw bar is displaceable.

7 Claims, 4 Drawing Sheets

VEHICLE ENGINE STARTER HAVING IMPROVED MEANS FOR ATTACHING THE DRAW MEMBER OF THE CONTRACTOR TO THE CONTROL FORK FOR THE STARTER HEAD

FIELD OF THE INVENTION

The present invention relates to motor vehicle starters, and more particularly to a starter for an engine of a motor vehicle which includes a starter head arranged to be actuated in longitudinal motion, between a working or engaged position and a disengaged position, by a control lever or actuating fork, the starter being energised by an electrical contractor which includes an axially movable draw member coupled to the actuating fork by suitable attachment means.

More particularly, the invention relates to a starter of the above particular type in which: the control lever is articulated about a horizontal axis and has a free upper end which is attached to the rear free end of the draw member for actuating the lever: the free front end of the draw member has a head on which a compression spring bears, the compression spring being mounted within a movable core of the starter contractor; the contractor is adapted to cause the draw member to be displaced longitudinally in a direction substantially at right angles to the axis of articulation of the control lever; and the means whereby the draw member is attached to the lever include a portion defining a hook, which is arranged at the rear free end of the draw member and which is received in a complementary housing or recess formed, in facing relationship with it, in the upper free end of the control lever.

BACKGROUND OF THE INVENTION

In a known arrangement, the draw member is in the form of a rod of generally cylindrical cross section, the free front end of which includes a widened head having a profile of revolution, which is formed integrally with the rod or which is a separate component fixed to the rod. The main body portion of the draw member has a constant circular cross section, and extends through the compression spring and through a hole which is formed in the rear transverse end wall of the movable core. It therefore extends axially beyond the core towards the rear of the assembly, so that it can be attached to the control lever for the starter head. For this purpose, and again in a known arrangement, the rear free end of the rod which constitutes the draw member has a pin of small diameter which is fitted diametrically through it. The two ends of this pin project radially on either side of the body of the draw rod, so as to form a T-shaped end that constitutes a hook. This hook is received in a complementary housing or recess in the upper free end of the control lever.

The compression spring which is interposed between the movable core and the widened head of the draw rod ensures that the transverse pin, acting as a hook, is held in engagement in the base of the corresponding housing or recess in the upper free end of the control lever. The base of this recess has a rounded profile which is complementary to the cross section of the transverse pin of the draw member, so as to enable the rear free end of the draw member to pivot with respect to the upper free end of the control lever, about an axis which is substantially parallel to the axis of articulation of the control lever.

From the operational point of view, this arrangement is quite satisfactory. However, it does have the drawback that it calls for a relatively heavy draw member, which thus represents a significant additional weight, while at the same time making it necessary to carry out a separate operation of fitting the pin in the draw rod.

DISCUSSION OF THE INVENTION

The object of the present invention is to provide a starter of the kind mentioned above, but which includes improved attachment means that overcome the above mentioned drawbacks.

According to the invention, a starter for a motor vehicle engine, of the type including a starter head, on which a control lever acts, the control lever being articulated about a horizontal axis, the control lever being a so-called actuating fork, having a free upper end which is attached to the rear free end of a draw member for actuating the control lever, the free front end of the draw member having a head on which a compression spring bears, the compression spring being mounted within a movable core of a starter contractor which is adapted to cause the draw member to be displaced longitudinally in a direction substantially at right angles to the axis of articulation of the lever, the starter being also of the type in which the means for attaching the draw member to the lever include a portion defining a hook, which is arranged at the rear free end of the draw member and which is received in a complementary housing or recess formed, in facing relationship with the hook, in the upper free end of the lever, the draw member being an element having the general form of a plate lying in a plane which contains the said direction of displacement, is characterised in that the draw member comprises a main body portion of rectangular form which extends longitudinally within the compression spring, and which has a free front end that includes at least one transverse lug projecting in the plane of the plate so as to constitute, at least partly, the thrust head for engagement by the compression spring, the rear free end of the draw member being extended by a hook portion.

According to a preferred feature of the invention, the said hook portion has a transverse width which is no greater than the width of the rectangular body portion of the draw member, the hook portion being formed with at least one lateral cut-out defining a hook.

According to another preferred feature of the invention, the said lateral cut-out or cut-outs, and the recess in the upper free end of the control lever, have complementary profiles which permit relative pivoting movement of the hook portion within the recess about a geometric axis which is substantially parallel to the axis of articulation of the control lever.

The recess formed in the upper free end of the control lever is preferably bounded by two parallel lateral retaining elements which are perpendicular to the axis of articulation of the control lever.

In one version of an attachment means according to the invention, the plate-shaped draw member, or draw bar, lies in a plane substantially at right angles to the axis of articulation of the lever. In another version, it lies in a plane substantially parallel to the axis of articulation of the control lever.

According to yet another preferred feature of the invention, the said hook portion at the rear end of the draw member has two opposed lateral cut-out portions defining a bridge element between them, and the upper free end of the control lever is formed with a vertically oriented slot which is open at the top, so as to permit attachment of the draw member to the control lever by introducing, vertically into the slot, the bridge element of the hook portion at the rear end of the draw member that lies between the two opposed lateral cut-outs.

Further features and advantages of the invention will appear more clearly on a reading of the following detailed description of some preferred embodiments of the invention, given by way of non-limiting example only and with reference to the accompanying drawings.

DESCRIPTION OF PREFERRED EMBODIMENTS OF THE INVENTION

In this description, components or elements which are identical or similar to each other are designated by the same reference signs.

Figure 1:
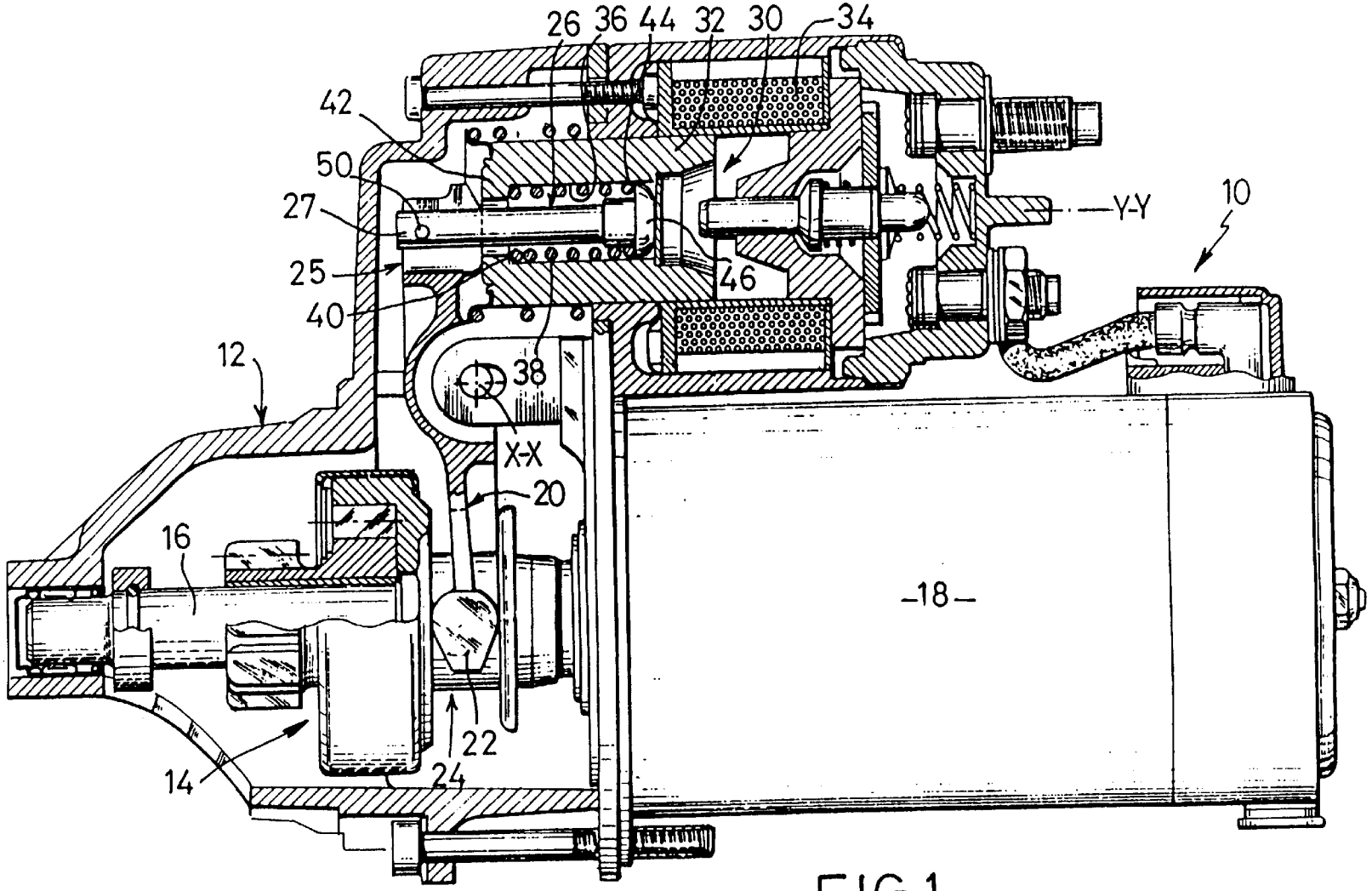
FIG.1 PRIOR ART
FIG. 1 is a simplified view, in partial cross section taken on a median plane at right angles to the axis of articulation of the control lever, and showing a motor vehicle starter in which the means for attaching the lever to the contractor are made in accordance with the prior art.

Reference is first made to FIG. 1, illustrating a typical example of a starter 10 according to the current state of the art. The starter 10 is designed to equip a motor vehicle internal combustion engine (not shown), and consists essentially of a casing 12, within which there is a starter head 14. The starter head 14 is mounted for sliding movement on one end of a shaft 16 which is driven in rotation by an electric starter motor 18. The sliding movements of the starter head 14 are caused by a control lever or actuating fork 20, which pivots inside the casing 12 about a horizontal geometric axis of articulation X—X.

The lower free end 22 of the control lever 20 acts on an actuating element 24 which is fixed to, or part of, the driving head 14, while the upper free end 25 of the lever 20 is coupled to a draw member 26 which is part of an electromagnetic contractor 30 arranged in the upper part of the starter 10.

In this known design, the contractor 30 comprises a movable core 32, which is displaceable along a horizontal axis Y—Y substantially perpendicular to the pivot axis X—X of the lever —0. These displacements of the movable core 32 are controlled by a solenoid winding 34. The movable core 32 is a generally cylindrical, hollow, annular component which is guided in axial sliding movement by its outer cylindrical surface. The internal bore 36 of the core 32 receives a helical compression spring 38. The spring 38 bears, through its rear end 40 which is on the left hand side in FIG. 1, against a radial shoulder at that end of the bore 36. This bore 36 is bounded by the rear transverse wall 42 of the movable core 32. The spring 38 also bears, through its free front end 44 towards the right in FIG. 1, against a widened head 46 which is carried at, or is part of, the free front end of the draw member 26. In the current state of the art, the draw member 26 and its head 46 are solid elements in the form of bodies of revolution about the axis Y—Y.

Figure 2:
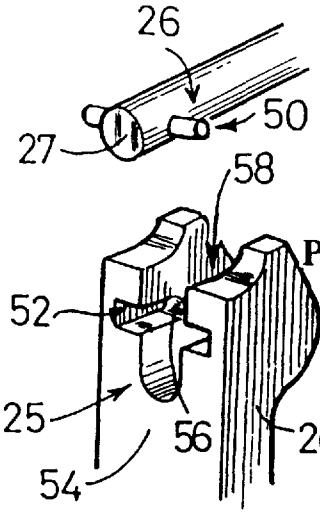
FIG. 2 PRIOR ART
FIG. 2 is an exploded detailed perspective view showing the attachment means, again in accordance with the current state of the art.

Reference is now also made to FIG. 2, which shows in greater detail how the free rear end 27 of the draw member 26 is coupled to the upper free end 25 of the control lever 20 in this prior art arrangement. The free rear end 27 carries a pin 50 which extends diametrically through the cylindrical rod that constitutes the draw member 26. The pin 50 projects radially on either side of the draw rod 26 so as to define with the latter a T-shaped hook. The upper free end 25 of the control lever 20 is configured in a complementary way. For this purpose it is formed with a recess 52 in the form of a notch, which is open axially towards the rear in the rear transverse face 54 of the control lever 20. The base 56 of the notch 52 has a rounded profile which is complementary to the cross section of the diametral pin 50.

In order to facilitate assembly, and therefore attachment, of the free rear end 27 of the draw member 26 with the upper free end 25 of the control lever 20, the latter has a vertical slot 58 which is open at the top and which is oriented in a plane at right angles to the axis of articulation X—X of the control lever, and substantially in the plane which contains the direction of displacement Y—Y of the draw member 26. The width of the slot 58 is of course slightly greater than the diameter of the draw rod 26.

In the assembled state of the various components, that is to say in the state shown in FIG. 1, the compression spring 38 has, among its known functions, that of holding the transverse pin 50 in axial engagement against the base 56 of the notch 52.

Figure 3:
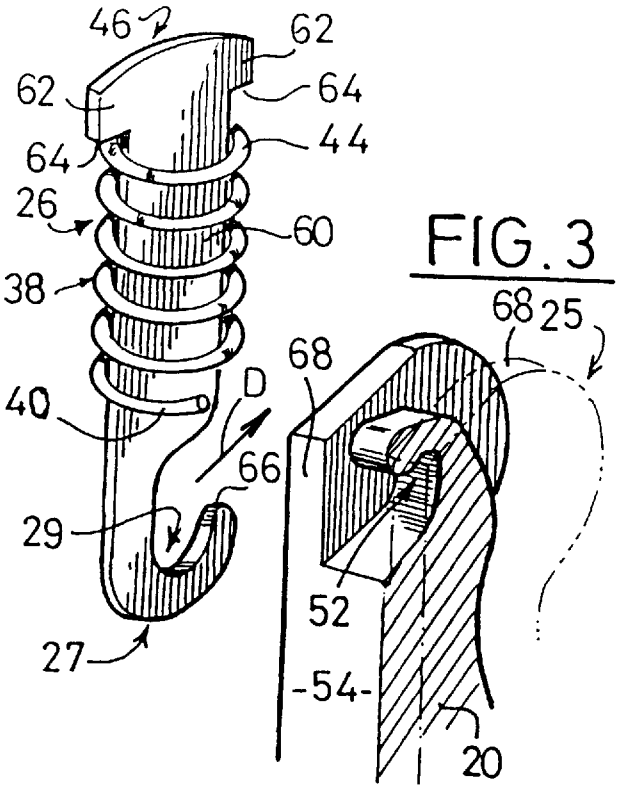
FIG. 3 is a view similar to FIG. 2, except that it shows a first embodiment of a draw member and attachment means made in accordance with features of the present invention, the draw member being shown in an intermediate position for its hooked attachment on the upper free end of the lever.
Figure 4:
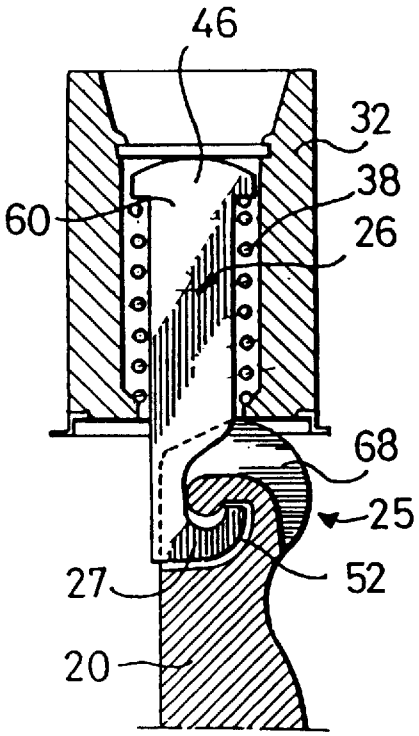
FIG. 4 shows the same components as in FIG. 3, but in partial ross section taken on a median plane of the lever and draw member, at right angles to the axis of articulation of the lever.
Figure 5:
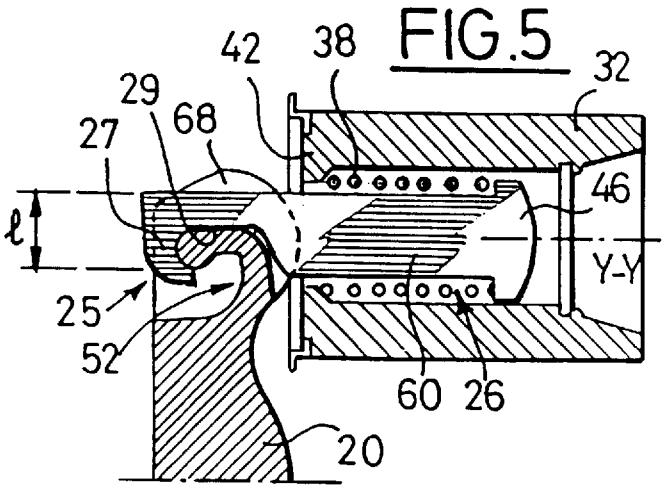
FIG. 5 is a view similar to FIG. 4 but showing the relative positions of the draw member and the control lever in the engaged (or hooked together) condition.

Reference will now be made to FIGS. 3 to 5, showing a first embodiment of a draw member in accordance with the invention. In this example, the draw member 26 is a component in the form of a plate, which may for example be a stamping made from sheet metal. The plate-like draw member 26 will be referred to for convenience here as a draw bar.

In the working, or hooked, condition shown in FIG. 5, in which the draw bar 26 is mounted within the movable core 32, the draw bar lies in a plane which substantially contains the direction of displacement Y—Y of the movable core 32. As shown in FIG. 5, the draw bar lies in a plane at right angles to the pivot axis X—X of the control lever 20.

In this example, the draw bar 26 comprises essentially a draw bar body 60 of generally rectangular form, the width of which, measured in the transverse direction 1 , is slightly smaller than the diameter of the spring 38, and slightly smaller than that of the hole formed in the rear transverse end wall 42 of the movable core 32. The thrust head 46 of the draw bar 26, corresponding in function to the head 46 in FIG. 1, and bearing on the free front end 44 of the spring 38, is formed by stamping integrally with the rectangular body portion 60 of the draw bar 26. In this example, the thrust head 46 comprises two opposed lugs 62, oriented transversely and projecting at right angles away from each other. Each lug 62 defines a shoulder 64 on which the spring 38 is engaged.

The body portion 60 is extended longitudinally at its other end by a rear end portion 27 in the form of a hook. As can be seen, especially, in FIG. 5, the transverse width of the hook portion 27 is at least equal to the transverse width I of the rectangular body portion 60, so as to enable it to pass through the spring 38 and into the hole which is defined within the rear transverse wall 42 of the movable core 32.

As can be seen in the version shown in FIGS. 3 to 5, the hook-shaped rear end portion 27 is defined by a cut-out portion 29 in the form of an open loop, which defines an aperture 66 that enables the hook 27 to be introduced in the direction D indicated in FIG. 3 into the complementary recess 52 formed in the rear transverse face 54 of the upper free end 25 of the control lever 20.

In the assembly operation, starting with the relative positions of the draw bar 26 and control lever 20 shown in FIG. 3, in which the draw bar 26 extends in a direction substantially parallel to the vertical general direction of the control lever 20, the draw bar 26 and control lever 20 are brought together. Once the hook 27 has been introduced into the recess 52, the free upper end 25 of the control lever 20 is pivoted with respect to the hook 27 about an axis substantially parallel to the pivot axis X—X, so as to put the two components 20 and 26 into the relative positions shown in FIG. 5. In order to then prevent any accidental escape of the hook 27 from the recess 52 in a direction parallel to the pivot axis X—X, the recess 52 is bounded by two parallel, opposed retaining portions 68 which lie in planes at right angles to the axis X—X. In addition, and as is best seen in FIG. 5, the recess 52 and the hook 27 are also configured in such a way as to prevent any escape of the hook 27 axially out of the recess 52.

Figure 6:
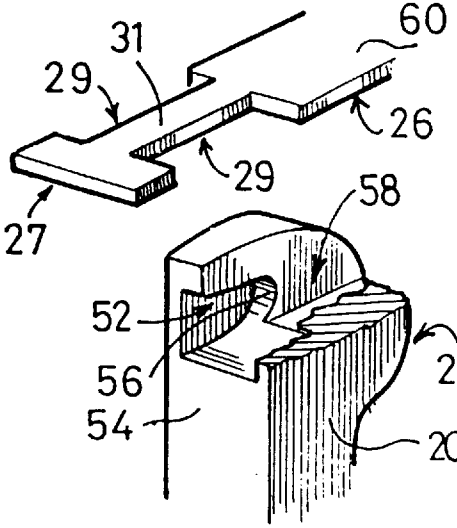
FIG. 6 is a view similar to FIG. 3, but shows a second embodiment of a draw member and control lever, in an attachment means in accordance with features of the invention.

The second embodiment shown in FIG. 6 will now be described. In this version, the general plane of the draw bar 26, again in the general form of a plate, is substantially parallel to the pivot axis X—X. The hook 27 in this version is defined by two opposed lateral cut-out portions 29, which give the end 27 of the draw bar a T-shaped profile equivalent to that of the end 27 of the draw bar 26 in the current state of the art, as shown for example in FIG. 2.

The width of the slot 58, which enables the hook 27 to be introduced in a vertical downward direction into its recess 52, is in this example slightly greater than the width of the bridge portion 31 of the draw bar 26, which is a bridge of metal between the two opposed lateral cut-out portions 29.

What is claimed is:

1. A motor vehicle starter, including: a starter head; means mounting the starter head for axial movement; a control lever; means defining an articulation axis for the control lever and mounting the control lever for pivoting movement about said articulation axis, the control lever having an upper end and a lower end, said lower end being engaged with the starter head for actuation of the starter head in said axial movement thereof; a starter contractor defining an axial direction substantially perpendicular to the said articulation axis, the contractor including a hollow core, means mounting the said core for movement in the said axial direction, a draw member having a rear end and a front end, the front end of the draw member being received within the said core with its rear end projecting from the core, for longitudinal movement of the draw member in the core in said axial direction, the front end of the draw member having a thrust head, and the contractor further including a compression spring mounted within the core and engaging the said thrust head of the draw member at one end of the spring, whereby to cause the draw member to be displaced longitudinally in the said axial direction with respect to the core, the starter further including attachment means coupling the rear end of the draw member to the upper end of the control lever, whereby said displacements of the draw member in the said axial direction cause the control lever to pivot about the said articulation axis so as to displace the starter head axially, the said rear end of the draw member comprising a hook portion of the draw member, the said upper end of the control lever defining a housing complementary to the said hook portion and in facing relationship with the said hook portion, the said hook portion being received in the said complementary housing, whereby said hook portion and housing constitute together the said attachment means, the draw member being generally in the form of a plate lying in a plane containing the said axial direction, wherein the draw member comprises a generally rectangular body portion extending longitudinally within the said spring and having a free front end constituting the said front end of the draw member and including at least one transverse lug coplanar with the said body portion and at least partly constituting the said thrust head, the body portion of the draw member having a rear end, the said hook portion extending the body portion at said rear end.

2. A starter according to claim 1, wherein the said hook portion of the draw member has a first transverse width and the rectangular body portion has a second transverse width at least equal to the said first transverse width, the draw member defining at least one lateral cut-out defining the said hook portion thereof.

3. A starter according to claim 2, wherein the said at least one lateral cut-out and the said housing of the control lever have respective profiles complementary to each other to enable the hook portion of the draw member to pivot with respect to the said housing, the housing defining a geometric axis substantially parallel to the said articulation axis of the control lever, whereby to permit relative pivoting movement of the hook portion in the said housing about the said geometric axis.

4. A starter according to claim 2, wherein the said upper end of the control lever further includes two lateral retaining portions bounding the said housing, the said retaining portions being parallel to each other and extending at right angles to the said axis of articulation.

5. A starter according to claim 1, wherein the draw member, in the form of a flat plate, lies in a plane substantially at right angles to the said articulation axis.

6. A starter according to claim 1, wherein the draw member, in the form of a flat plate, lies in a plane substantially parallel to the said articulation axis.

7. A starter according to claim 1, wherein the draw member, in the form of a flat plate, lies in a plane substantially parallel to the said articulation axis, and wherein the hook portion at the rear end of the draw member comprises a longitudinal bridge portion defining two opposed lateral cut-outs on either side of the bridge portion, the said upper end of the control lever having a vertical slot open at the top, whereby to enable the said bridge portion of the draw member to be introduced vertically into the said slot so as to attach the draw member to the control lever.

* * * * *

UNITED STATES PATENT AND TRADEMARK OFFICE

CERTIFICATE OF CORRECTION

PATENT NO.: 5,878,621

DATED: March 9, 1999

INVENTOR(S): Gilles Vadin-Michaud

It is certified that errors appear in the above-identified patent and that said Letters Patent is hereby corrected as shown below:

In the title [54], please delete "CONTRACTOR" and insert therefor -- CONTACTOR --.

In the abstract [57], please delete all occurrences of "contractor" (2 places) and insert therefor -- contactor --.

In column 1, line 3, please delete "CONTRACTOR" and insert therefor -- CONTACTOR --.

In column 1, line 14, please delete "contractor" and insert therefor -- contactor --.

In column 1, line 23, please delete all occurrences of "contractor" (2 places) and insert therefor -- contactor--.

In column 2, line 19, please delete "contractor" and insert therefor -- contactor --.

In column 3, line 13, please delete "contractor" and insert therefor -- contactor --.

In column 3, line 25, please delete "ross" and insert therefor -- cross --.

In column 3, line 57, please delete "contractor" and insert therefor -- contactor --.

In column 3, line 59, please delete "contractor" and insert therefor -- contactor --.

In column 3, line 62, please delete "--0" and insert therefor -- 20 --.

In column 5, line 1, please delete "I" and insert therefor -- 1 --.

In claim 1, col. 5, line 52, please delete "contractor" and insert therefor -- contactor --.

In claim 1, col. 5, line 54, please delete "contractor" and insert therefor -- contactor --.

UNITED STATES PATENT AND TRADEMARK OFFICE

CERTIFICATE OF CORRECTION

PATENT NO. : 5,878,621
DATED : March 9, 1999
INVENTOR(S) : Gilles Vadin-Michaud

It is certified that error appears in the above-indentified patent and that said Letters Patent is hereby corrected as shown below:

In claim 1, col. 5, line 61, please delete "contractor" and insert therefor -- contactor --.

Signed and Sealed this

Fifth Day of October, 1999

*Attest:*

Q. TODD DICKINSON

*Attesting Officer*

*Acting Commissioner of Patents and Trademarks*